US008776572B2

(12) United States Patent
Weis

(10) Patent No.: US 8,776,572 B2
(45) Date of Patent: Jul. 15, 2014

(54) NECKING MACHINE

(75) Inventor: Manfred Weis, Radolfszell (DE)

(73) Assignee: Mall + Herlan Schweiz AG, Pfyn (CH)

( * ) Notice: Subject to any disclaimer, the term of this patent is extended or adjusted under 35 U.S.C. 154(b) by 220 days.

(21) Appl. No.: 13/215,313

(22) Filed: Aug. 23, 2011

(65) Prior Publication Data

US 2012/0060578 A1 Mar. 15, 2012

(30) Foreign Application Priority Data

Sep. 15, 2010 (CH) ..... 01484/10

(51) Int. Cl.
*B21D 51/26* (2006.01)
*B21D 41/04* (2006.01)

(52) U.S. Cl.
USPC ..... 72/452.5; 72/405.01; 72/446; 72/449; 100/282; 100/292

(58) Field of Classification Search
USPC ..... 72/446, 447, 449, 452.5, 405.01; 100/282, 292
See application file for complete search history.

(56) References Cited

U.S. PATENT DOCUMENTS

| | | | | |
|---|---|---|---|---|
| 4,402,204 | A * | 9/1983 | Russell et al. | 72/131 |
| 4,607,513 | A * | 8/1986 | Russell | 72/137 |
| 4,793,171 | A * | 12/1988 | Russell | 72/449 |
| 6,021,683 | A | 2/2000 | Doege et al. | |
| 6,401,683 | B1 * | 6/2002 | Stokes et al. | 123/197.1 |

FOREIGN PATENT DOCUMENTS

| | | |
|---|---|---|
| DE | 1452744 | 6/1969 |
| DE | 196 01 300 A1 | 7/1997 |
| DE | 19815655 | 10/1999 |
| EP | 0219676 | 4/1987 |
| EP | 0275369 | 7/1988 |
| EP | 1531017 | 5/2005 |
| WO | 01/58618 | 8/2001 |

* cited by examiner

*Primary Examiner* — David B Jones
(74) *Attorney, Agent, or Firm* — Volpe and Koenig, P.C.

(57) ABSTRACT

A necking machine (1) having a plurality of processing stations on a rotating tool carrier (7). The motion of the tool carrier (7) with respect to the work pieces is carried out by a crankshaft (25). This is carried out by a non-constant gear. The gear includes two non-round gearwheels (21, 23) that improve a rotational-speed profile of the crankshaft (25) and thus a velocity profile, in particular, in an area of the dead center.

5 Claims, 5 Drawing Sheets

NECKING MACHINE

CROSS-REFERENCE TO RELATED APPLICATIONS

This application claims the benefit of Swiss Patent Application No. 01484/10, filed Sep. 15, 2010, which is incorporated herein by reference as if fully set forth.

BACKGROUND

The present invention is directed to a necking machine for can bodies.

In the production of can bodies, especially of so-called two-piece cans with a one-piece blank for beverages and cosmetics, etc., a plurality of processing steps must be carried out on the open end of the can blank. On one hand, the margin (the edge) that has received an irregular shape in the deep-drawing or elongation process must be cut, typically on a trimming machine. Furthermore, the can blanks are often necked at the open end, in order to form a flared tube end or a thread with a flared tube end. Covers or lids whose diameters typically have, in the area connecting to the can body or can blank, a smaller diameter than the base of the can are often placed on the necked, open end. These processing steps are carried out on so-called necking machines. These machines comprise an annular work-piece holder that is arranged on the machine housing of the necking machine. On a corresponding annular tool holder, a plurality of tools are arranged for carrying out the individual processing steps. The tool carrier sits on a cylindrical tube that can be shifted in the axial direction in the machine housing and can be moved in the axial direction by a crank drive. Before each work stroke, the work pieces arranged on the work-piece holder are rotated by a specified angle, so that for each stroke, a subsequent tool comes into contact with the can bodies set on the work-piece carrier.

Currently, the number of cycles of necking machines equals about 200 cycles per minute.

The processing time is the time during which the processing steps, such as milling, rolling threads, rolling beads, or forming flared tube ends, are carried out on the work pieces with turning tools. These processing steps take place in the last phase of each work stroke, i.e., approximately in the last 25 mm before the dead center. For the processing of the work pieces, there remains about 0.043 seconds. If the number of cycles were increased by 25%, then the processing time would be reduced accordingly. This would lead to a reduction in quality.

Through the design of the crank drive and displacement of the axis of rotation of the crank drive from the axis of the advancing piston, it is possible to change individual phases of the advancing movement slightly compared to the law of motion of the planar crank drive. However, such changes are always associated with accompanying, unavoidable effects on other areas of the path of motion. In addition, the accelerations then have unequal profiles at both dead centers. This means that the machine must be designed for a permissible maximum value. During a cycle, however, this is reached shortly only once. Depending on the ratio between the stroke length and connecting-rod length of the machine, the achieved maximum value of the acceleration in the half of the movement with the lower loads lies between about 75% (shorter stroke) and 50% (longer stroke) of the maximum value of the total motion.

Another possibility for influencing the law of motion is the direct drive by a servomotor, which, however, would represent an inefficient method due to the large masses being moved (>1000 kg) and the resulting high driving energy. A linear drive could be constructed as a directly acting linear motor or as a direct drive of the crankshaft. In the second case, the accuracy of the machine is given by the crank mechanics. Only the path of motion must be reset each time. In the first case, both magnitudes for each stroke must be newly set by the electronics, which would mean a higher risk of failure.

SUMMARY

One objective of the present invention is to influence the path of motion in each stroke/cycle such that, despite a higher number of cycles, the processing time remains equal or becomes longer around the front dead center compared to current processing times.

This objective is achieved by a device according to the invention. Advantageous constructions of the machine are described in detail below and in the claims.

Through a non-constant transmission ratio of the gear between the drive motor and crankshaft, it is possible to lengthen the processing time, without increased loads being generated by higher accelerations at a different location. Thus it is possible to produce more processing time despite the greater number of cycles.

The construction of the drive train according to the invention for the crankshaft allows a flywheel mass to be advanced as an energy accumulator. Through its function as an energy accumulator, the machine can still be operated with a comparatively low energy expense despite higher output. The design of a non-round gear makes it possible to selectively delay the area of the work stroke in which the processes described above are carried out and simultaneously to optimize the other areas of motion for minimal total cycle time for limited, but nearly maximum acceleration used multiple times within one revolution. As a result, for a 25%-higher number of cycles, the processing times are increased by 15% compared to current values and the utilization of the maximum-achieved accelerations increases for the parts of motion with the lower accelerations to about 98% (shortest stroke) to 88% (slowest stroke) of the maximum value of the total motion.

BRIEF DESCRIPTION OF THE DRAWINGS

With reference to an illustrated embodiment, the invention will be explained in more detail. Shown are.

DETAILED DESCRIPTION OF THE PREFERRED EMBODIMENTS

Figure 1:
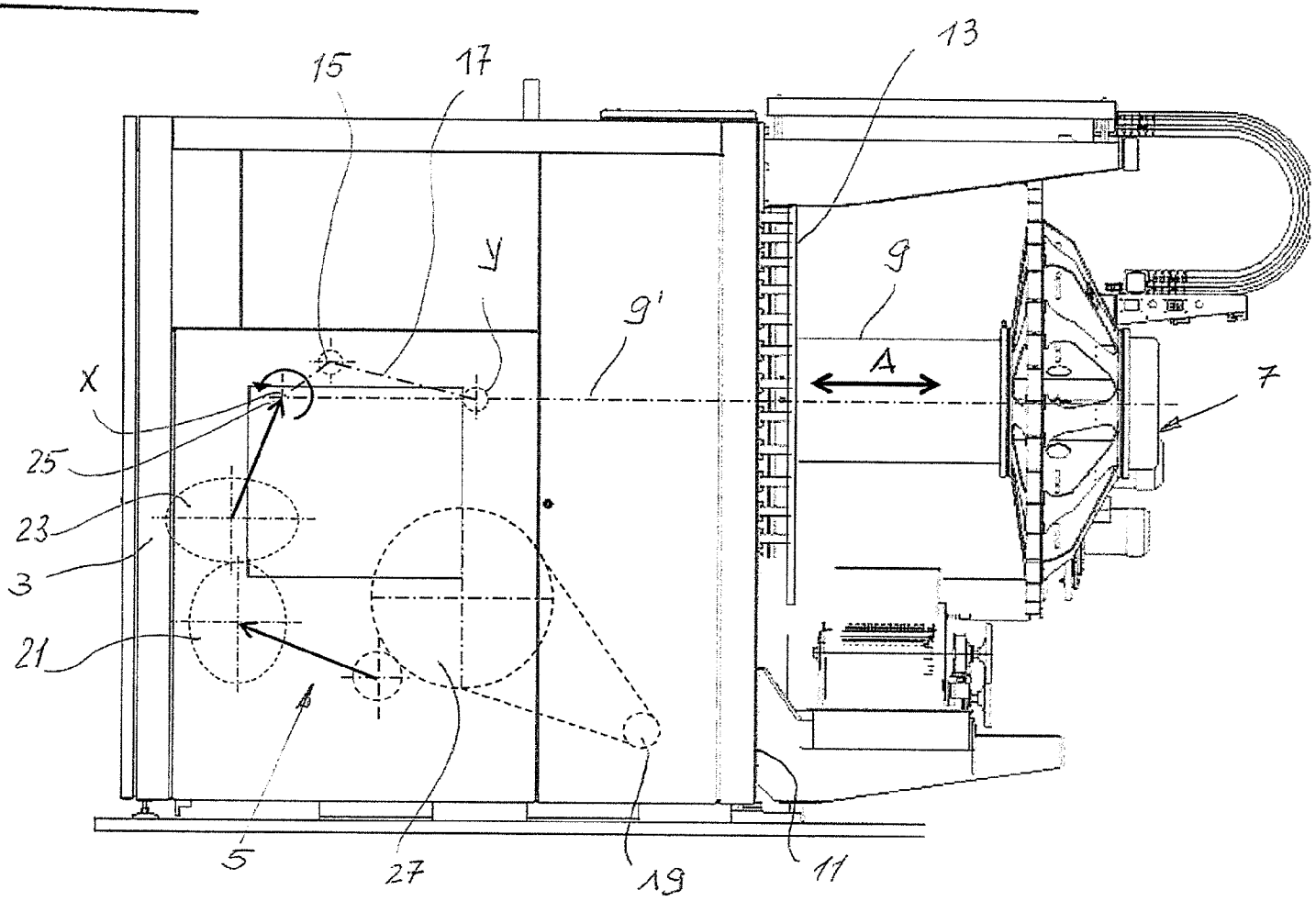
FIG. 1 is a schematic side view of a necking machine.

With reference symbol 1, a necking machine is shown schematically, seen from the side. This comprises a housing 3 that holds the drive elements and carries the tools. On the right side of the figure, a tool carrier 7 can be seen that sits on the end of a shaft 9 that can move in a linear displacement in the direction of the arrows A. Furthermore, on the front wall 11 of the housing 3, a work-piece carrier 13 is visible on which can bodies or blanks (not shown) are held in a stackable way.

The tool carrier 7 has a disk-like construction and carries a number, e.g., 30 tools, with which the neck of an elongated or deep-drawn can blank can be processed, e.g., milled, flanged, drawn in, or flattened. The construction of the work-piece carrier 13 and the tool carrier 7, as well as the drives and tools arranged on the latter are known from the prior art.

In the interior of the housing 3, the rotational direction of a crankshaft is shown schematically with arrow B, wherein this crankshaft is supported so that it can rotate about an axis of rotation X with crank pin 15. On the crank pin 15 sits a connecting rod 17 that attaches with a pivoting motion to the axis Y on the end of the shaft 9. The axis Y of the shaft 9 is designated in the interior of the housing 3 with reference symbol 9'. This intersects the axis X. A drive motor 19 drives the shaft of a first non-round gearwheel 21 with an overdrive, e.g., a toothed belt. This first gearwheel meshes with a second non-round gearwheel 23 that is in active connection, via its shaft, with the crankshaft 25 that drives the connecting rod 17.

With reference symbol 27, a flywheel mass is designated that provides for the highest possible stability of rotational speed. The two elliptical gearwheels 21, 23 shown in FIG. 1 are only shown as ellipses for the sake of illustrative simplicity. They do not represent a construction according to the invention.

Figure 2:
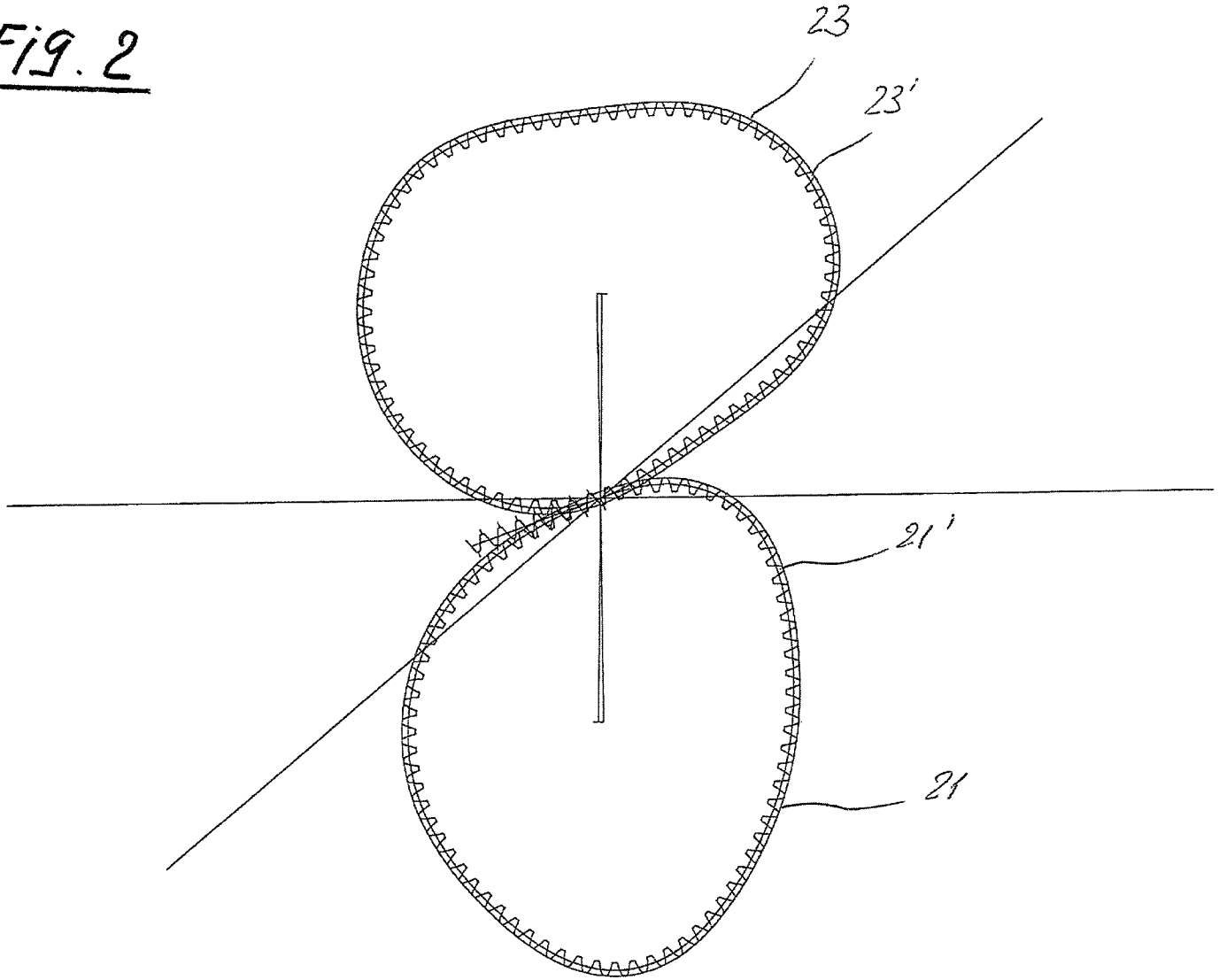
FIG. 2 is a side view of the gear with non-linear transmission.
Figure 3:
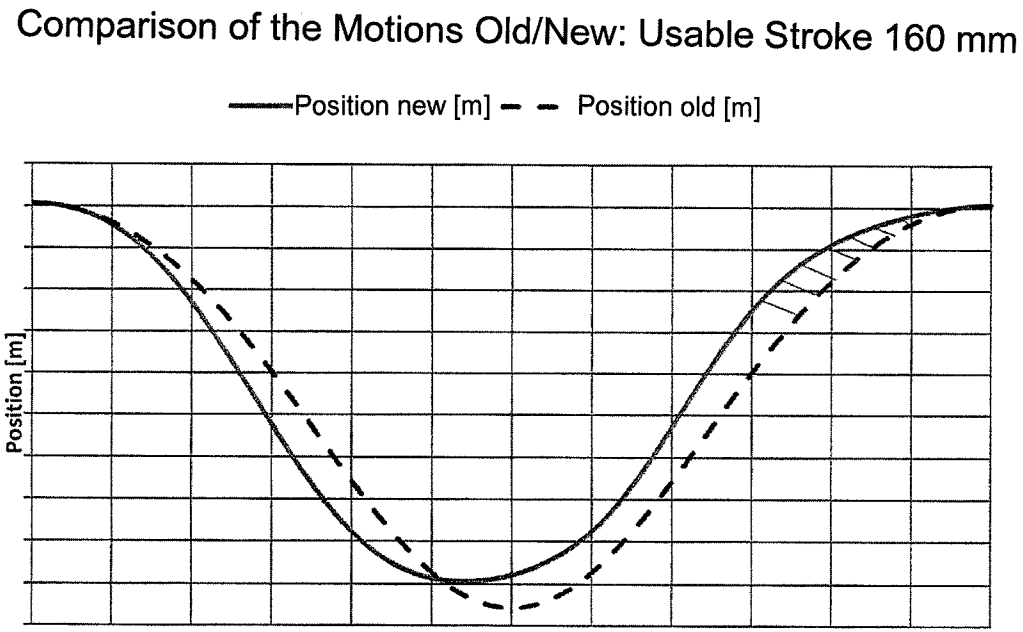
FIG. 3 is a graph showing comparison curves of the motions.
Figure 4:
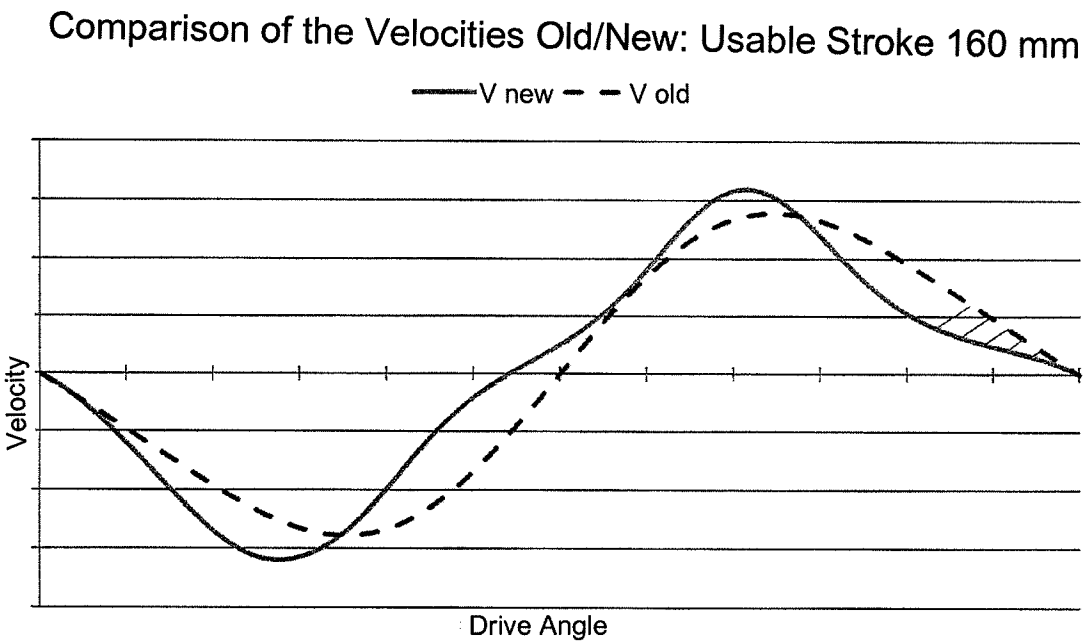
FIG. 4 is a graph showing comparison curves of the velocities.

According to the invention, the two gearwheels 21 and 23 are constructed not following a basic geometrical shape (see FIG. 2). Their teeth 21' and 23' lie on a periphery that transfers a non-constant rotational-speed profile to the drive shaft of the crankshaft, producing the calculated path of motion in the direction of the arrows A of the tool carrier 7. The path of motion is shown as an example in FIG. 3, wherein the solid curve represents the profile according to the invention and the broken curve represents the path of motion of known necking machines. In FIG. 4 it is visible that the previous velocity profile corresponds essentially to a sine wave (dashed line), the velocity profile according to the invention shows the longer dwell time of the tool carrier moved in this way in the axial direction in the direction of arrows A during the processing of the can body (narrow profile in the right area of FIGS. 3 and 4 with cross-hatching).

Figure 5:
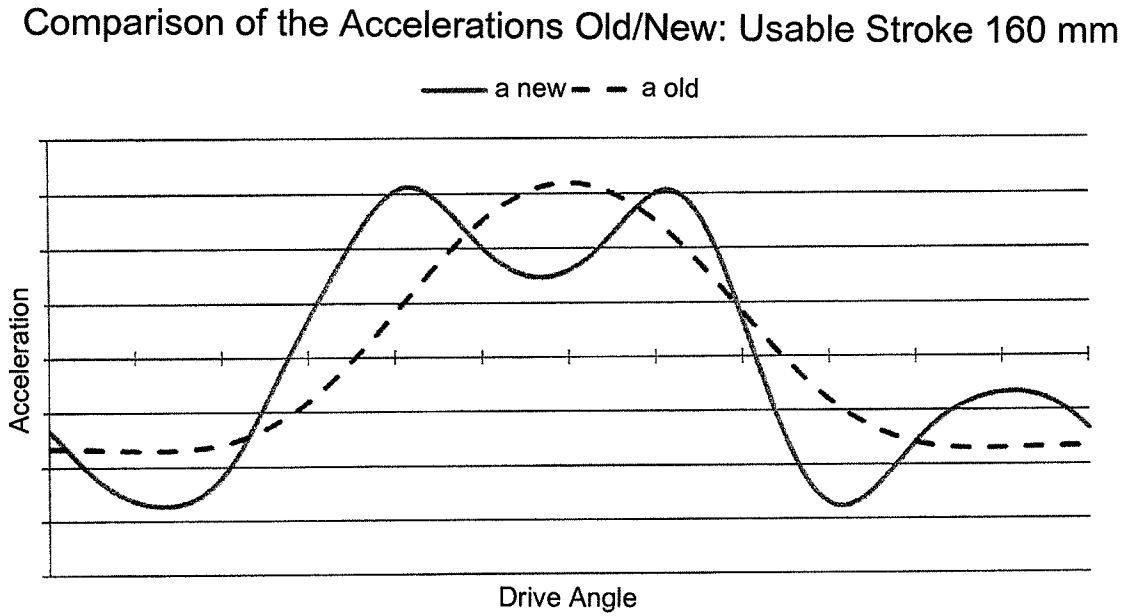
FIG. 5 is a graph showing comparison curves of the accelerations.

From FIG. 5, the accelerations of the work-piece carrier 13 moved in a known way in comparison to the tool carrier 7 driven according to the invention (solid line) are visible. Here, from FIG. 5 it clearly emerges that, despite a 25%-higher number of cycles, the acceleration values in the work stroke (right area) are not larger, but the dwell time between the two positive and negative maximum values of the acceleration are almost equally large and are each achieved twice for each movement.

LEGEND OF THE REFERENCE SYMBOLS

1 Necking machine
3 Housing
5 Drive elements
7 Tool carrier
9 Shaft
11 Front wall
13 Work-piece carrier
15 Crank pin
17 Connecting rod
19 Drive motor
21 $1^{st}$ non-round gearwheel
23 $2^{nd}$ non-round gearwheel
25 Crankshaft
27 Flywheel

The invention claimed is:

1. A necking machine (1) for containers comprising: a machine housing: a tool carrier (7) supported for axial displacement on the machine housing: a plurality of processing stations on the tool carrier (7) that process necks of the containers, a drive train including a drive motor and a crank drive having a connecting rod (17) connected to a crankshaft (25) supported in the machine housing in active connection with the tool carrier (7) that generates an axial stroke of the tool carrier relative to a work-piece carrier (13) located on the machine housing, the axial stroke having a dwell time during which the processing stations process the necks of the containers, and a gear having a non-constant transmission ratio located in the drive train of the crankshaft (25) between the drive motor (19) and the crankshaft (25), the non-constant transmission ratio controls the dwell time.

2. The necking machine according to claim 1, wherein the gear comprises at least one gearwheel (21, 23) having teeth (21', 23') that are arranged on a non-circular track.

3. The necking machine according to claim 1, wherein the gear comprises two non-round gearwheels (21, 23), each having teeth that are arranged on non-circular tracks, that are each supported rotatably on fixed shafts located in the machine housing and mesh with each other.

4. The necking machine according to claim 3, wherein the two gearwheels (21, 23) have different geometric constructions.

5. The necking machine according to claim 1, wherein the gear increases the dwell time around a dead center of a movement of the connecting rod.

* * * * *